US011241882B2

(12) United States Patent
Hirai

(10) Patent No.: US 11,241,882 B2
(45) Date of Patent: Feb. 8, 2022

(54) LIQUID DISCHARGE HEAD

(71) Applicant: Brother Kogyo Kabushiki Kaisha, Nagoya (JP)

(72) Inventor: Keita Hirai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/905,491

(22) Filed: Jun. 18, 2020

(65) Prior Publication Data

US 2021/0031516 A1 Feb. 4, 2021

(30) Foreign Application Priority Data

Aug. 1, 2019 (JP) ..... JP2019-141967

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2002/14241; B41J 2002/14491; B41J 2/14233
See application file for complete search history.

(56) References Cited

U.S. PATENT DOCUMENTS

2015/0273832 A1* 10/2015 Hirai ..... B41J 2/1637 347/71
2017/0087825 A1 3/2017 Kato et al.

FOREIGN PATENT DOCUMENTS

JP 2017-065094 A 4/2017
JP 2018-158552 A 10/2018

OTHER PUBLICATIONS

Machine Translation of JP 2018158552 A , Kawakubo, Takashi et al., pp. 8-10 (Year: 2021).*
IP.com search (Year: 2021).*

* cited by examiner

*Primary Examiner* — Lisa Solomon
(74) *Attorney, Agent, or Firm* — Banner & Witcoff, Ltd.

(57) ABSTRACT

A liquid discharge head includes: a first substrate having pressure chambers, the first substrate having a first surface in which nozzles communicating with the pressure chambers are open and a second surface in which first holes and second holes communicating with the pressure chambers are open; a piezoelectric actuator arranged on the second surface of the first substrate and configured to apply discharge energy to liquid inside the pressure chambers; a second substrate joined to the second surface of the first substrate and having first channels and second channels, the first channels communicating with the pressure chambers via the first holes, the second channels communicating with the pressure chambers via the second holes; first ring-shaped traces connected to the piezoelectric actuator and each surrounding one of the first holes; and second ring-shaped traces connected to the piezoelectric actuator and each surrounding one of the second holes.

11 Claims, 7 Drawing Sheets

LIQUID DISCHARGE HEAD

CROSS REFERENCE TO RELATED APPLICATION

The present application claims priority from Japanese Patent Application No. 2019-141967, filed on Aug. 1, 2019, the disclosure of which is incorporated herein by reference in its entirety.

BACKGROUND

Field of the Invention

The present disclosure relates to a liquid discharge head which discharges liquid from a nozzle.

Description of the Related Art

There is a known ink-jet recording head (see Japanese Patent Application Laid-open No. 2018-158552) as a liquid discharge head which is provided with a nozzle, a pressure chamber communicating with the nozzle, an ink supply channel connected to one end of the pressure chamber, and an ink exhaust channel connected to the other end of the pressure chamber. In the ink-jet recording head, the ink is circulated via the ink supply channel, the pressure chamber, and the ink exhaust channel. With this, it is possible to prevent any sedimentation of an ink component inside an ink channel and any drying of the ink in the vicinity of the nozzle. Further, it is also possible to exhaust an air bubble entering into and mixed with the ink inside the ink channel.

SUMMARY

In the above-described ink-jet recording head, the ink supply channel and the ink exhaust channel are formed in a substrate which is different from another substrate in which the pressure chamber is formed. Further, the substrate in which the ink supply channel and the ink exhaust channel are formed is joined to the upper surface of the another substrate in which the pressure chamber is formed, thereby allowing the ink supply channel and the ink exhaust channel to communicate with the pressure chamber. Here, a piezoelectric element applying discharge energy to the ink inside the pressure chamber is arranged on the upper surface of the another substrate in which the pressure chamber is formed such that the piezoelectric element faces the pressure chamber. Accordingly, in such a case that any unsatisfactory joining (joining failure) is occurred between the substrate in which the ink supply channel and the ink exhaust channel are formed and the another substrate in which the pressure chamber is formed, there is such a possibility that the ink might flow out from a connection part at which the ink supply channel and the pressure chamber are connected to each other and/or a connection part at which the ink exhaust channel and the pressure chamber are connected to each other, and that the ink might reach the piezoelectric element.

An object of the present disclosure is to provide a liquid discharge head in which it is possible to reduce such a possibility that the outflowed ink might reach the piezoelectric element, even in a case that the ink flows out from the connection part at which the ink supply channel and the pressure chamber are connected to each other and/or the connection part at which the ink discharge channel and the pressure chamber are connected to each other.

According to an aspect of the present disclosure, there is provided a liquid discharge head including: a first substrate having a plurality of pressure chambers formed therein, the first substrate having: a first surface in which a plurality of nozzles communicating with the pressure chambers respectively are open; and a second surface which is on a side opposite to the first surface and in which a plurality of first holes communicating with the pressure chambers respectively and a plurality of second holes communicating with the pressure chambers respectively are open; a piezoelectric actuator which is arranged on the second surface of the first substrate, and which is configured to apply discharge energy to liquid inside the pressure chambers; a second substrate which is joined to the second surface of the first substrate, and in which a plurality of first channels and a plurality of second channels are formed, the first channels communicating with the pressure chambers via the first holes respectively, the second channels communicating with the pressure chambers via the second holes respectively; a plurality of first ring-shaped traces which are connected to the piezoelectric actuator, and each of which surrounds one of the first holes on the second surface of the first substrate; and a plurality of second ring-shaped traces which are connected to the piezoelectric actuator, and each of which surrounds one of the second holes on the second surface of the first substrate.

In the liquid discharge head according to the aspect of the present disclosure, each of the pressure chambers communicates with one of the first channels and one of the second channels which correspond thereto and which are formed in the second substrate, via one of the first holes and one of the second holes formed in the second surface of the first substrate. Each of the first holes is surrounded by one of the first ring-shaped traces, and each of the second holes is surrounded by one of the second ring-shaped traces. Accordingly, even in such a case that the liquid flows out from the connection part at which each of the pressure chambers and one of the first channels are connected to each other and/or the connection part at which each of the pressure chambers and one of the second channels are connected to each other, such outflowed liquid can be interrupted by the first ring-shaped trace and/or the second ring-shaped trace. As a result, it is possible to reduce such a possibility that the liquid, outflowed from the connection parts might reach the piezoelectric actuator.

DESCRIPTION OF THE EMBODIMENTS

Figure 1:
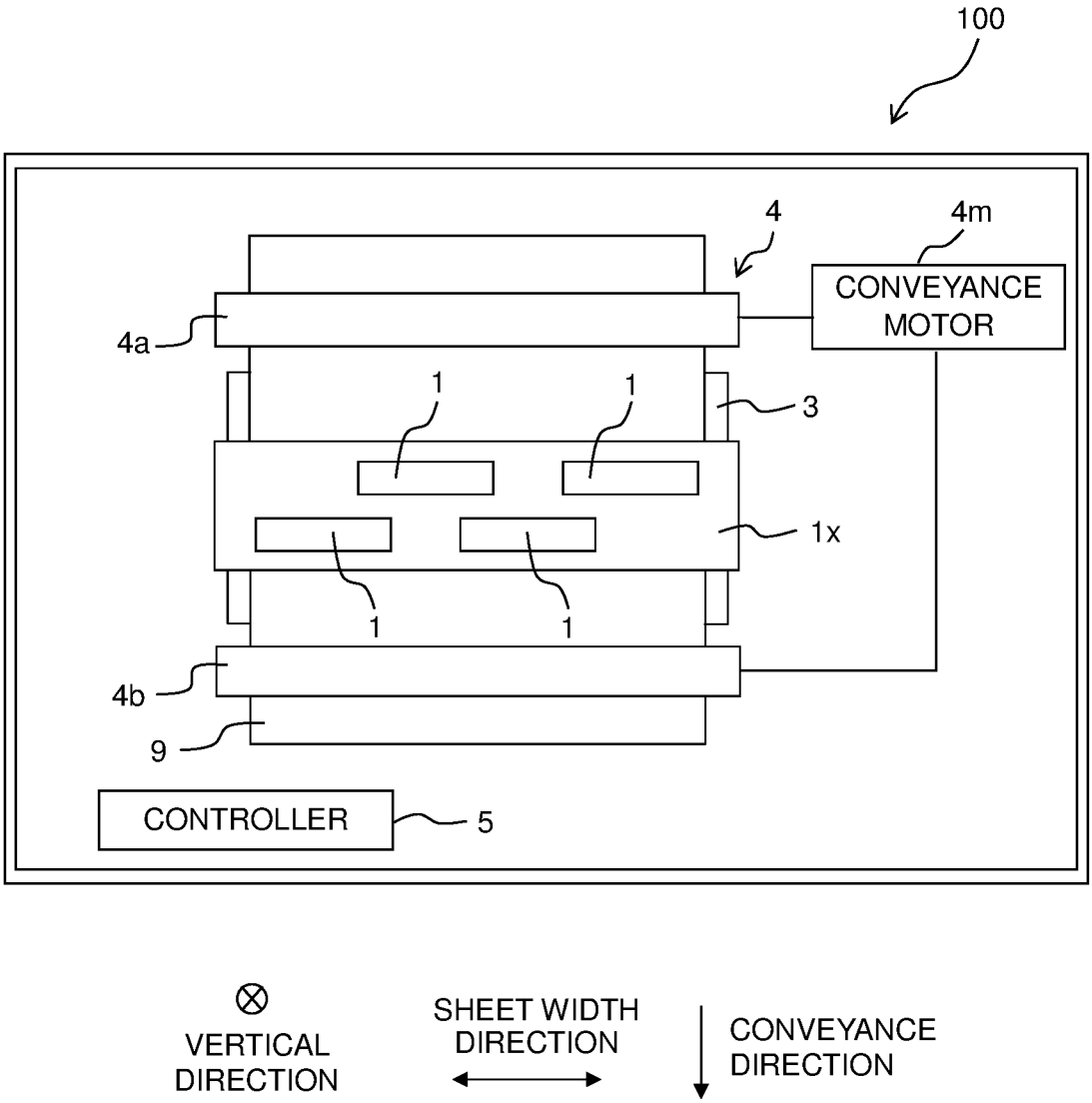
FIG. 1 is a plane view of a printer according to an embodiment of the present disclosure.

The overall configuration of a printer 100, provided with a head 1 according to an embodiment of the present disclosure, will be explained with reference to FIG. 1.

The printer 100 is provided with a head unit 1*x* including four heads 1 (each of which is an example of a liquid discharge head), a platen 3, a conveying mechanism 4 and a controller 5.

A sheet (paper) 9 is placed on the upper surface of the platen 3.

The conveying mechanism 4 is provided with two roller pairs 4*a* and 4*b*. In a case that a conveyance motor 4*m* is driven by control of the controller 5, the roller pairs 4*a* and 4*b* rotate in a state that the sheet 9 is sandwiched or pinched therebetween, thereby conveying the sheet 9 in a conveyance direction (an example of a first direction). The two roller pairs 4*a* and 4*b* are arranged so as to sandwich the platen 3 therebetween in the conveyance direction.

The head unit 1*x* is elongated in a sheet width direction (an example of a second direction), and the head unit 1*x* is of a line system wherein ink is discharged with respect to the sheet 9 from nozzles 11*n* (see FIGS. 2 and 4) in a state that the head unit 1*x* is fixed to the printer 100. The four heads 1 are arranged in a staggered manner in the sheet width direction.

Here, in the present embodiment, the sheet width direction is orthogonal to the conveyance direction. The sheet width direction and the conveyance direction are both orthogonal to the vertical direction.

The controller 5 has a Read Only Memory (ROM), a Random Access Memory (RAM) and an Application Specific Integrated Circuit (ASIC). The ASIC performs a recording processing, etc., in accordance with a program stored in the ROM. In the recording processing, the controller 5 controls a driver IC 19 (see FIG. 4) of each of the heads 1 and the conveyance motor 4*m*, based on a recording instruction (including image data) inputted from an external apparatus such as a PC, and performs recording of an image, etc., on the sheet 9. Specifically, the controller 5 alternately executes a discharging processing of causing ink droplets from the nozzles 11*n* and a conveying processing of conveying, by the roller pairs 4*a* and 4*b*, the sheet 9 in the conveyance direction at a predetermined conveyance amount.

Next, the configuration of each of the heads 1 will be explained, with reference to FIGS. 2 to 6.

Figure 2:
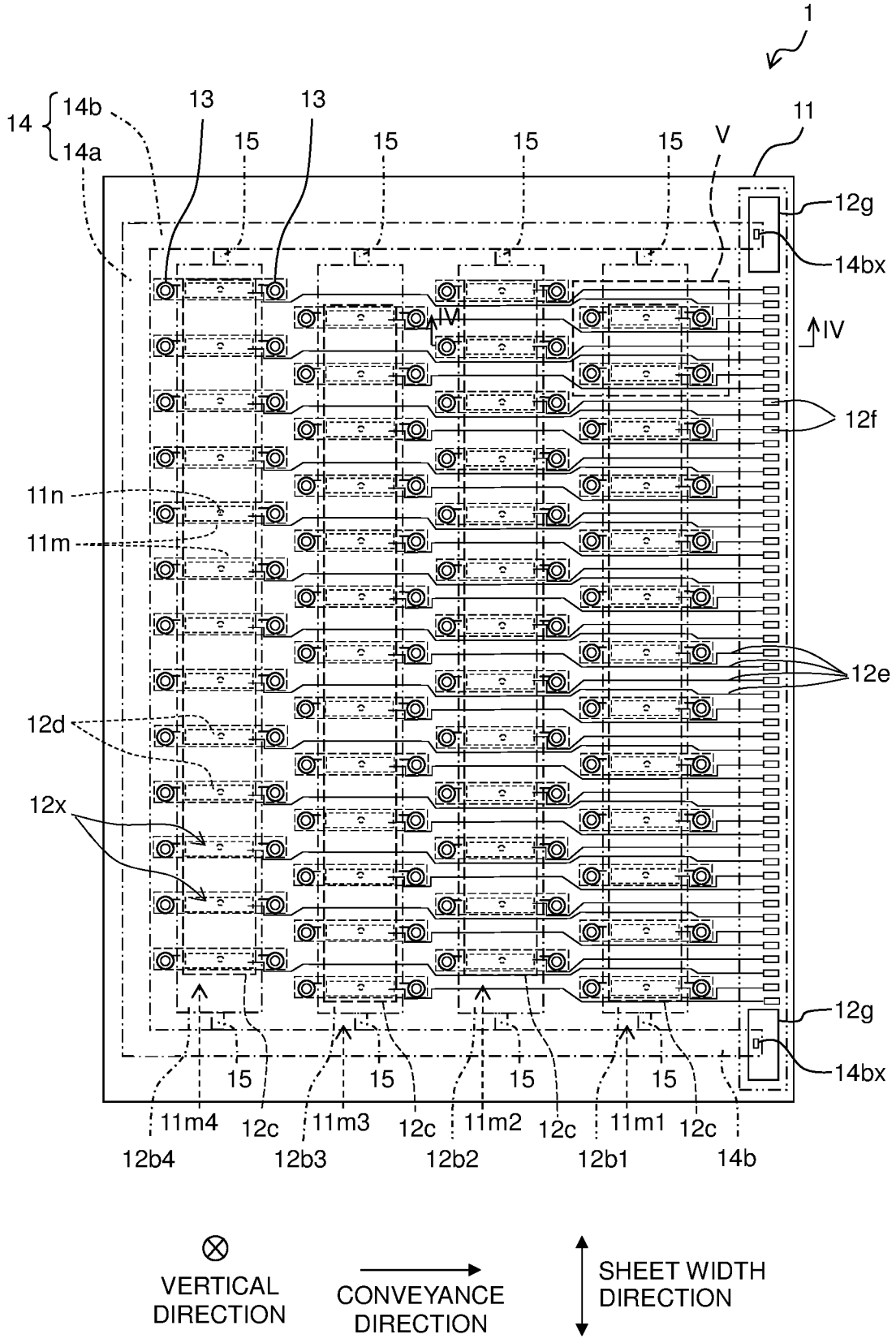
FIG. 2 is a plane view of a head included in the printer.
Figure 4:
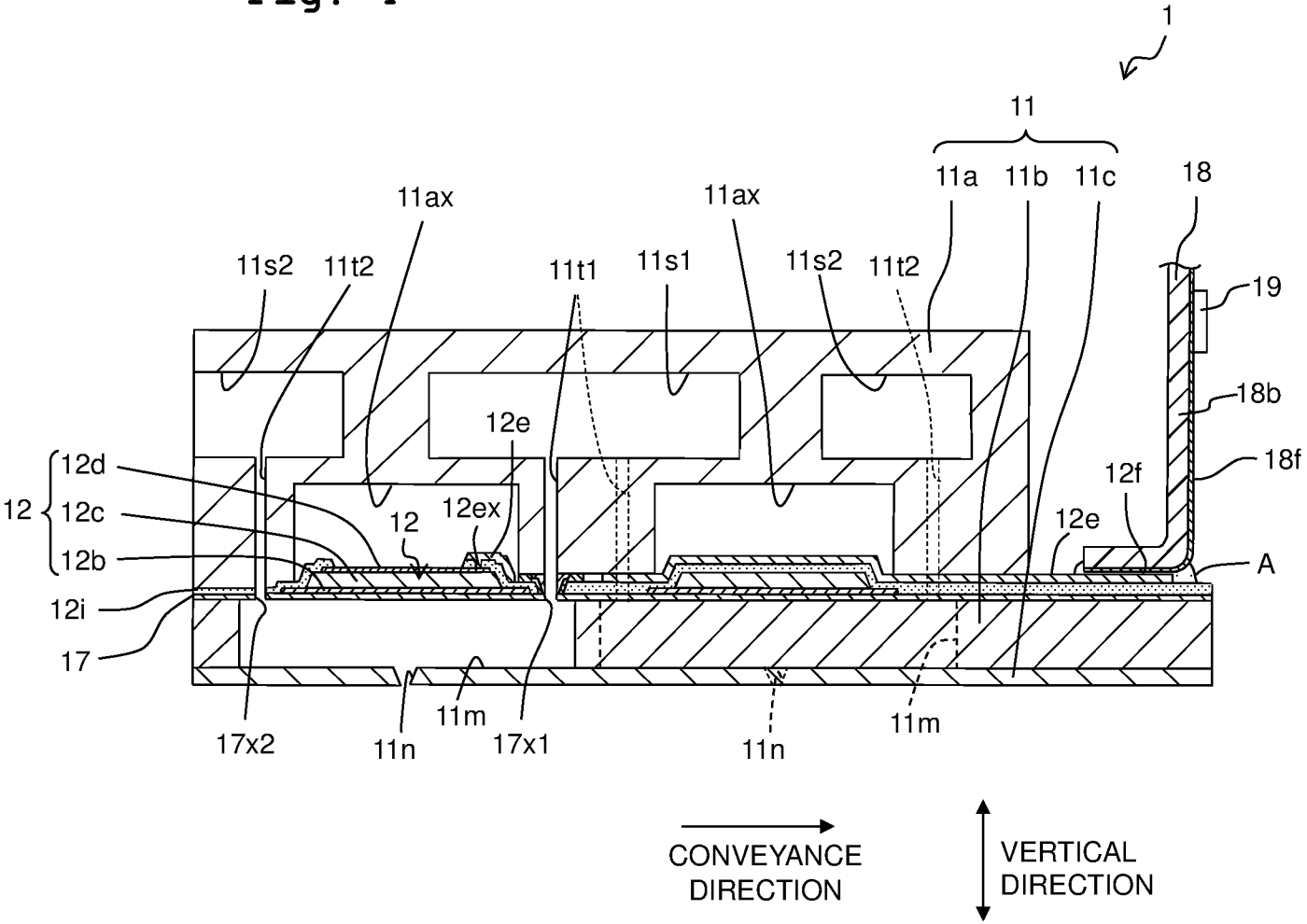
FIG. 4 is a cross-sectional view of the head, along a IV-IV line in FIG. 2.

As depicted in FIGS. 2 and 4, the head 1 has a channel substrate 11, a piezoelectric actuator 12 and a COF 18 (an example of a wiring member).

As depicted in FIG. 4, the channel substrate 11 has a reservoir member 11*a*, a pressure chamber plate 11*b* and a nozzle plate 11*c*. Note that in FIG. 2, the illustration of the reservoir member 11*a* is omitted.

The pressure chamber plate 11*b* is formed with a plurality of pressure chambers 11*m*. The nozzle plate 11*c* is formed with a plurality of nozzles 11*n* communicating with the plurality of pressure chambers 11*m*, respectively. The reservoir member 11*a* is formed with a plurality of common supply channels 11*s*1 and a plurality of common return channels 11*s*2. Each of the common supply channels 11*s*1 and each of the common return channels 11*s*2 are common channels with respect to the pressure chambers 11*m*. Each of the common supply channels 11*s*1 and each of the common return channels 11*s*2 communicate with a tank (not depicted) which stores the ink.

As depicted in FIG. 2, the plurality of pressure chambers 11*m* are aligned in the sheet width direction, and construct four pressure chamber rows 11*m*1 to 11*m*4 arranged side by side in the conveyance direction. In each of the pressure chamber rows 11*m*1 to 11*m*4, the pressure chambers 11*m* are arranged in the sheet width direction at equal spacing distances therebetween. Pressure chambers 11*m* which construct the pressure chamber rows 11*m*1 and 11*m*2 are arranged in the staggered manner such that the positions in the sheet width direction of the pressure chambers 11*m* are different from one another. Pressure chambers 11*m* which construct the pressure chamber rows 11*m*3 and 11*m*4 are arranged in the staggered manner such that the positions in the sheet width direction of the pressure chambers 11*m* are different from one another.

As depicted in FIG. 2, the nozzles 11*n* are aligned in the sheet width direction, and construct four nozzle rows which are arranged side by side in the conveyance direction, similarly to the pressure chambers 11*m*. In each of the nozzle rows, the nozzles 11*n* are arranged at equal spacing distances therebetween in the sheet width direction. Nozzles 11*n* constructing two nozzle rows on the right side in FIG. 2 are arranged in the staggered manner such that the positions in the sheet width direction of the nozzles 11*n* are different from one another. Nozzles 11*n* constructing two nozzle rows on the left side in FIG. 2 are arranged in the staggered manner such that the positions in the sheet width direction of the nozzles 11*n* are different from one another.

As depicted in FIG. 4, the nozzle plate 11*c* is adhered to the lower surface of the pressure chamber plate 11*b*. Namely, the nozzle plate 11*c* is arranged on a side opposite to the piezoelectric actuator 12 with respect to the pressure chamber plate 11*b*. The lower surface of the nozzle plate 11*c* is an example of a first surface of the present disclosure.

The reservoir member 11*a* is adhered to the upper surface of the pressure chamber plate 11*b*, via the piezoelectric actuator 12.

In addition to the common supply channels 11*s*1 and the common return channels 11*s*2, the reservoir member 11*a* is formed with: a plurality of supply channels 11*t*1 each of which communicates one of the pressure chambers 11*m* with one of the common supply channels 11*s*1, and a plurality of return channels 11*t*2 each of which communicates one of the pressure chambers 11*m* with one of the common return channels 11*s*2. Further, four recessed parts 11*ax* each of which extends in the sheet width direction are formed in the reservoir member 11*a*. The four recessed parts 11*ax* are formed in the lower surface of the reservoir member 11*a*, and face the pressure chamber rows 11*m*1 to 11*m*4, respectively, in the vertical direction. The supply channels 11*t*1 are examples of first channels of the present disclosure, and the return channels 11*t*2 are examples of second channels of the present disclosure.

A vibration plate 17 is provided on the upper surface of the pressure chamber plate 11*b*. The vibration plate 17 is an insulating layer formed, for example, by oxidizing or nitriding a surface of a silicon single crystal substrate constructing the pressure chamber plate 11*b*, and is arranged on substantially the entirety of the upper surface of the pressure chamber plate 11*b*. The vibration plate 17 is arranged between the piezoelectric actuator 12 and the pressure chamber plate 11*b*, and covers the pressure chambers 11*m*. The upper surface of the vibration plate 17 is an example of a second surface of the present disclosure. Further, the nozzle plate 11*c*, the pressure chamber 11*b* and the vibration plate 17 are combined so as to collectively correspond to an example of a first substrate of the present disclosure.

In the vibration plate 17, through holes 17*x*1 (examples of first holes) are formed at portions, of the vibration plate 17, facing the supply channels 11*t*1 in the vertical direction. Further, in the vibration plate 17, through holes 17*x*2 (examples of second holes) are formed at portions, of the vibration plate 17, facing the return channels 11*t*2 in the vertical direction. In a case that a pump (not depicted) is driven, the ink inside the tank is supplied to the common supply channel 11*s*1, the ink passes through each of the supply channels 11*t*1 and one of the through holes 17*x*1 corresponding thereto, and the ink is supplied to one of the pressure chambers 11*m* corresponding thereto. Further, in the case that the pump is driven, the ink inside each of the pressure chambers 11*m* flows into one of the through holes 17*x*2 and one of the return channels 11*t*2 corresponding thereto, and then flows into the common return channel 11*s*2, and is recovered by the tank.

As depicted in FIG. 4, the piezoelectric actuator 12 is arranged on the upper surface of the pressure chamber plate 11*b* via the vibration plate 17, and covers all the pressure chambers 11*m* formed in the pressure chamber plate 11*b*.

The piezoelectric actuator 12 includes, in an order from the lower side thereof, a common electrode 12*b*, four piezoelectric bodies 12*c* and a plurality of individual electrodes 12*d*.

The common electrode 12*b* is arranged on the upper surface of the vibration plate 17.

Figure 3:
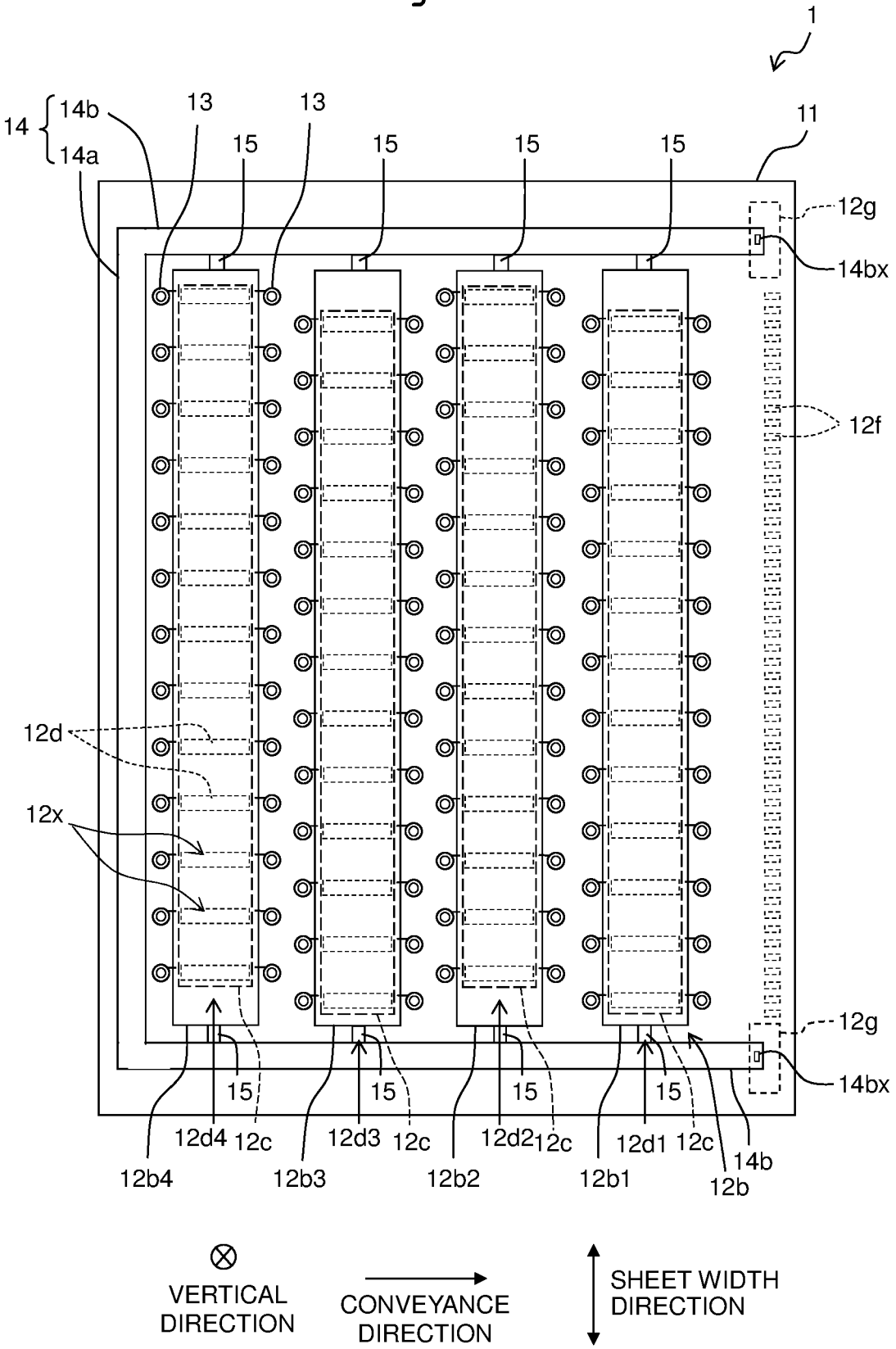
FIG. 3 is a plane view of the head, depicting a layer in which a common electrode of a piezoelectric actuator is formed.

As depicted in FIGS. 2 and 3, the common electrode 12*b* includes a first common electrode 12*b*1, a second common electrode 12*b*2, a third common electrode 12*b*3 and a fourth common electrode 12*b*4 which are separate and away from one another in the conveyance direction. Each of the first to fourth common electrodes 12*b*1 to 12*b*4 is a common electrode common to pressure chambers 11*m* which are included in the pressure chambers 11*m* and which construct one of the pressure chamber rows 11*m*1 to 11*m*4, and is arranged to face, in the vertical direction, the pressure chambers 11*m* constructing one of the pressure chamber rows 11*m*1 to 11*m*4. In other words, the common electrode 12 is divided into four corresponding to the pressure chamber rows 11*m*1 to 11*m*4. Each of the common electrodes 12*b*1 to 12*b*4 is formed, for example, of platinum (Pt).

As depicted in FIGS. 2 and 3, the four piezoelectric bodies 12*c* extend in the sheet width direction on the upper surfaces of the common electrodes 12*b*1 to 12*b*4, respectively, and cover all the pressure chambers 11*m* constructing the pressure chamber rows 11*m*1 to 11*m*4, respectively. Each of the piezoelectric bodies 12*c* is formed, for example, of lead zirconate titanate (PZT).

The individual electrodes 12*d* are arranged as individual electrodes 12*d* on each of the piezoelectric bodies 12*c*, and face the pressure chambers 11*m*, respectively, in the vertical direction.

As depicted in FIGS. 2 and 3, the individual electrodes 12*d* are aligned in the sheet width direction, and construct four individual electrode rows 12*d*1 to 12*d*4 which are arranged side by side in the conveyance direction, similarly to the pressure chambers 11*m*. Individual electrodes 12*d* which construct each of the four individual electrode rows 12*d*1 to 12*d*4 face one of the common electrodes 12*b*1 to 12*b*4 in the vertical direction. In each of the individual electrode rows 12*d*1 to 12*d*4, the individual electrodes 12*d* are arranged in the sheet width direction at equal spacing distances therebetween. Individual electrodes 12*d* constructing the individual electrode rows 12*d*1 and 12*d*2 which are on the right side in FIG. 3 are arranged in a staggered manner such that the positions in the sheet width direction of the individual electrodes 12*d* are different from one another. Individual electrodes 12*d* constructing the individual electrode rows 12*d*3 and 12*d*4 which are on the left side in FIG. 3 are arranged in a staggered manner such that the positions in the sheet width direction of the individual electrodes 12*d* are different from one another.

Each of the individual electrodes 12*d*, the common electrode 12*b*, and a portion in one of the piezoelectric bodies 12*c* which is sandwiched between each of the individual electrodes 12*d* and the common electrode 12*b* functions as a piezoelectric element 12*x* which is deformable in accordance with application of the voltage to each of the individual electrodes 12*d*. Namely, the piezoelectric actuator 12 has a plurality of piezoelectric elements 12*x* facing the pressure chambers 11*m*, respectively. In a case that each of the piezoelectric elements 12*x* is driven in accordance with application of the voltage to each of the individual electrodes 12*d* (for example, in a case that each of the piezoelectric elements 12*x* is deformed to project toward one of the pressure chambers 11*m*), this changes the volume of one of the pressure chambers 11*m*, thereby applying pressure to the ink inside the one of the pressure chambers 11*m*, and thus causing the ink to be discharged form one of the nozzles 11*n* corresponding thereto.

The piezoelectric actuator 12 further has a plurality of individual traces 12*e*, a plurality of individual contact points 12*f*, two common contact points 12*g*, a plurality of ring-shaped traces 13, a common trace 14 and a plurality of coupling traces 15. These traces 12*e*, 13 to 15 and the contact points 12*f*, 12*g* are formed of a same material (for example, aluminum (Al)).

Each of the individual traces 12*e* is provided on one of the individual electrodes 12*d*, and connects one of the individual electrodes 12*d* and one of plurality of individual contact points 12*f* corresponding thereto. Each of the ring-shaped traces 13 is connected to any one of the first to fourth common electrodes 12*b*1 to 12*b*4. The common trace 14 is connected to the first to fourth common electrodes 12*b*1 to 12*b*4 via the coupling traces 15. Further, the common trace 14 is connected to the two common contact points 12*g*.

As depicted in FIG. 4, the individual contact points 12*f* are disposed in an area of the pressure chamber plate 11*b* not covered with the reservoir member 11*a*. Similarly, the two common contact points 12*g* are also disposed in the area of the pressure chamber plate 11*b* not covered with the reservoir member 11*a*.

The individual contact points 12*f* and the two common contact points 12*g* are aligned in one row in the sheet width direction on one side in the conveyance direction (the right side in FIG. 3) with respect to a group constructed of all of the individual electrodes 12*d* provided on the piezoelectric actuator 12. The plurality of individual contact points 12*f* are arranged at equal spacing distances therebetween in the sheet width direction. The two common contact points 12*g* sandwich the individual contact points 12*f* therebetween in the sheet width direction.

The common trace 14 includes a facing part 14*a* (an example of a first part) and two connecting parts 14*b* (examples of two second parts). The facing part 14*a* is arranged on an upstream side in the conveyance direction (the left side in FIG. 3) with respect to the group constructed of all of the individual electrodes 12*d* provided on the piezoelectric actuator 12. The two connecting parts 14*b* extend from the both sides, respectively, in the conveyance direction of the facing part 14*a* (in the present embodiment, both ends in the sheet width direction of the facing part 14*a*) toward a downstream side in the conveyance direction (the right side in FIG. 3) and are connected to the two common contact points 12*g*, respectively. The facing part 14*a* and the two connecting parts 14*b* are formed integrally. The group of the individual electrodes 12*d* are surrounded by the common trace 14 and the row of the individual contact points 12*f*.

The facing part 14*a* is a rectangular part which is elongated in the sheet width direction. Each of the two connecting parts 14*b* is a rectangular part which is elongated in the conveyance direction. An end at the upstream side in the conveyance direction (left side in FIG. 3) of each connecting part 14*b* is connected to the facing part 14*a*. An end at the downstream side in the conveyance direction (right side in FIG. 3) of each connecting part 14*b* is electrically connected to each common contact points 12*g* via a part (contact part 14*bx*) that enters into a through hole of an insulating film 12*i* described below. Each of the two connecting parts 14*b* is coupled to the respective common electrodes 12*b*1 to 12*b*4 via the coupling traces 15, respectively.

Each of the common trace 14 and the coupling traces 15 has a width greater than that of the other traces 12*e* and 13. The plurality of individual traces 12*e* and the ring-shaped traces 13 have widths which are substantially same to each other. The plurality of individual traces 12*e*, the ring-shaped traces 13 and the coupling traces 15 have thicknesses which are substantially same to one another.

Each of the individual traces 12*e* extends in the conveyance direction. Each of the individual traces 12*e* has a contact point part 12*ex* (see FIG. 4) with respect to one of the individual electrodes 12*d* corresponding thereto, at one end in the conveyance direction of each of plurality of individual traces 12*e*, and has an individual contact point 12*f* at the other end in the conveyance direction of each of plurality of individual traces 12*e*.

The individual traces 12*e* that are connected to individual electrodes 12*d* (included in the individual electrodes 12*d* forming the individual electrode row 12*d*4, and except for the individual electrodes 12*d* positioned at the both ends in the sheet width direction) extend in the conveyance direction while passing through between the two individual electrodes 12*d* included in each of the individual electrode rows 12*d*1 to 12*d*3 and adjacent to each other in the sheet width direction. The individual traces 12*e* that are connected to individual electrodes 12*d* (included in the individual electrodes 12*d* forming the individual electrode row 12*d*3, and except for an individual electrode 12*d* positioned on one side in the sheet width direction (the lower side in FIG. 2)) extend in the conveyance direction while passing through between the two individual electrodes 12*d* included in each of the individual electrode rows 12*d*1 and 12*d*2 and adjacent to each other in the sheet width direction. The individual traces 12*e* that are connected to individual electrodes 12*d* (included in the individual electrodes 12*d* forming the individual electrode row 12*d*2, and except for an individual electrode 12*d* positioned on the other side in the sheet width direction (the upper side in FIG. 2)) extend in the conveyance direction while passing through between the two individual electrodes 12*d* included in the individual electrode rows 12*d*1 and adjacent to each other in the sheet width direction.

Figure 5:
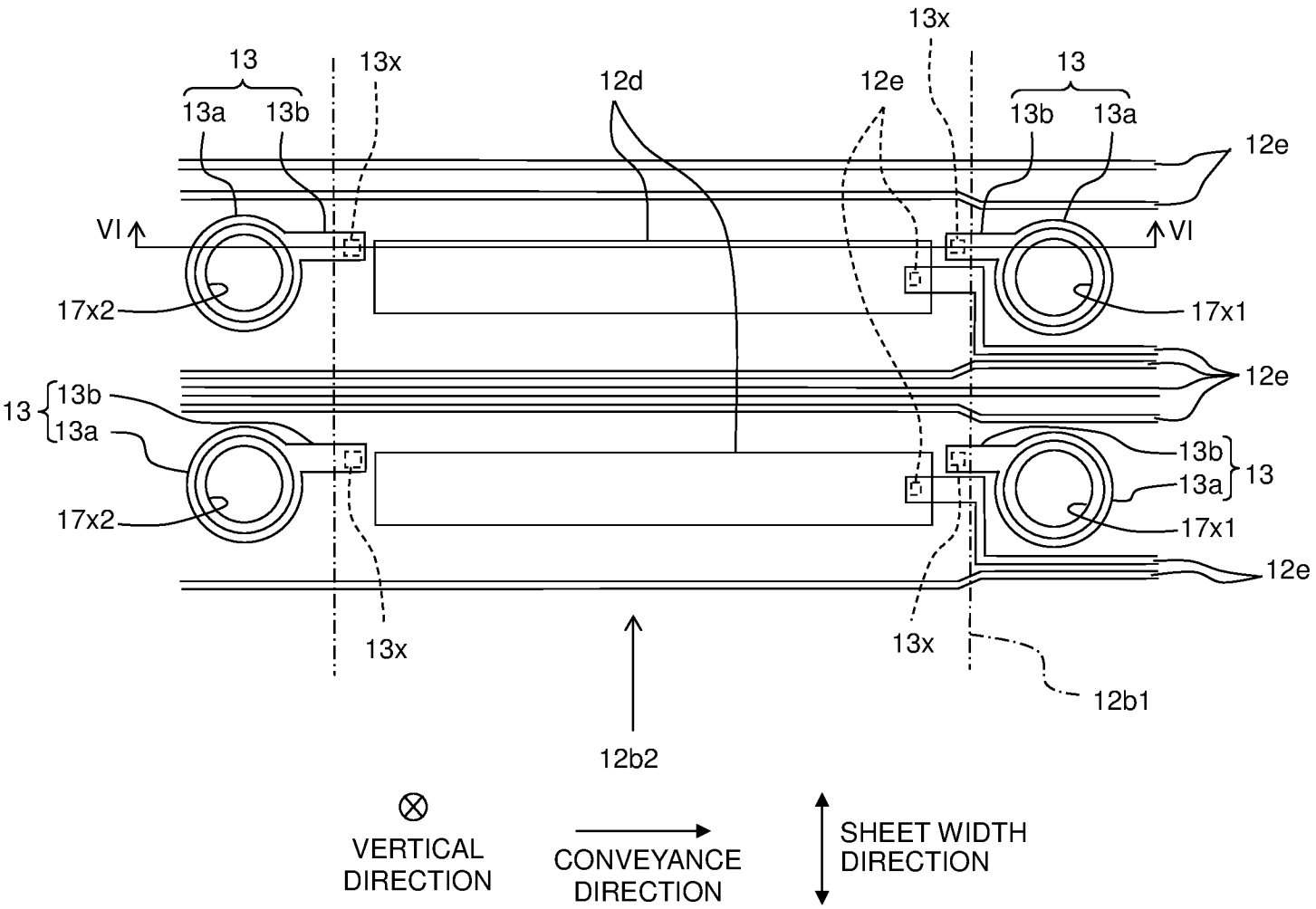
FIG. 5 is an enlarged view of an area V depicted in FIG. 2.
Figure 6:
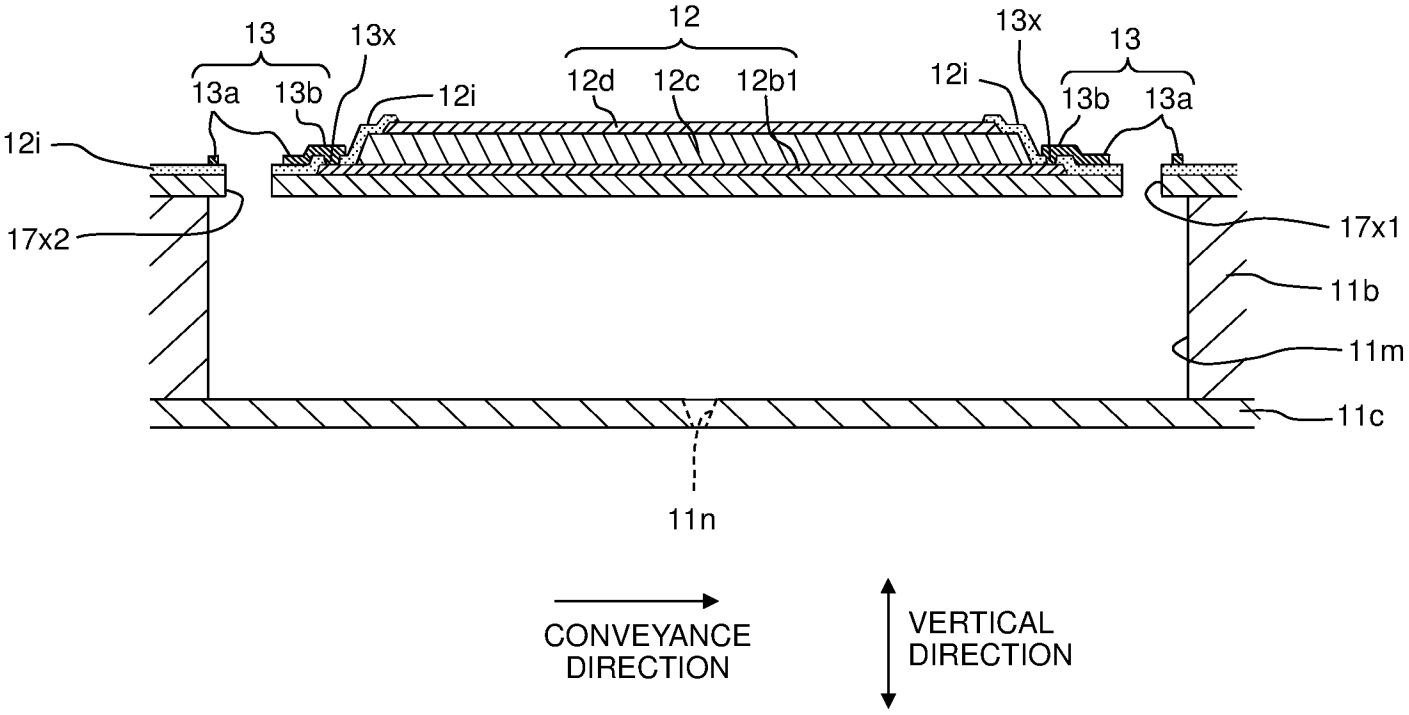
FIG. 6 is a cross-sectional view of the head, along a VI-VI line in FIG. 5.

As depicted in FIGS. 5 and 6, the ring-shaped traces 13 have ring-shaped parts 13*a* and extending parts 13*b*, respectively. Each of the extending parts 13*b* extends from one of the ring-shaped parts 13*a* in the conveyance direction. Each of the ring-shaped parts 13*a* is formed to surround one of the through holes 17*x*1 or one of the through holes 17*x*2. Each of the extending parts 13*b* has one end linked to one of the ring-shaped parts 13*a*, and the other end connected to the common electrode 12*b*. In the present embodiment, each of the ring-shaped traces 13 are arranged so as not to overlap with a partition wall between any two of the pressure chambers 11*m* which are adjacent to each other in the sheet width direction. Ring-shaped traces 13 which have the ring-shaped parts 13*a* surrounding the through holes 17*x*1 are examples of first ring-shaped traces. Ring-shaped traces 13 which have the ring-shaped parts 13*a* surrounding the through holes 17*x*2 are examples of second ring-shaped traces.

Note that in the present embodiment, in order to enhance the insulating property between each of the individual traces 12*e* and the common electrode 12*b*, an insulating film 12*i* (omitted in FIG. 2; see FIGS. 4 and 6) is provided. The insulating film 12*i* is arranged substantially on the entirety of the upper surface of the vibration plate 17, and covers the first to fourth common electrodes 12*b*1 to 12*b*4, the four piezoelectric bodies 12*c*, the common trace 14 and the coupling traces 15. Note, however, that the insulating film 12*i* covers only the outer peripheral part of each of the individual electrodes 12*d*, so as not to inhibit the driving of the piezoelectric elements 12*x*, and that a central part of each of the individual electrodes 12*d* is exposed from the insulating film 12*i*. The insulating film 12*i* is formed, for example, of silicon dioxide ($SiO_2$).

The individual traces 12*e*, the ring-shaped traces 13, the individual contact points 12*f* and the two common contact points 12*g* are arranged on the upper surface of the insulating film 12*i*.

The common trace 14 and the coupling traces 15 are arranged on the upper surface of the vibration plate 7 and arranged on the lower side relative to the insulating film 12*i*, similarly to the common electrode 12*b*.

Each of the individual traces 12*e* is electrically connected to one of the individual electrodes 12*d* corresponding thereto, via a part, of each of the individual traces 12*e* (contact point part 12*ex*) which enters into a through hole of the insulating film 12*i*. The extending parts 13*b* of the ring-shaped traces 13, respectively, are electrically connected to one of the first to fourth common electrodes 12*b*1 to 12*b*4, via parts (contact point parts 13*x*), of the extending parts 13*b* of the ring-shaped trace 13, respectively, each of which enters into a through hole of the insulating film 12*i*.

Each of the contact point parts 12*ex* is provided on an end part on one side in the conveyance direction (the right side in FIGS. 2 to 5) of one of the individual electrodes 12*d* corresponding thereto. Each of the contact point parts 13*x* is arranged at an end part on the one side in the conveyance direction (the right side in FIG. 5) or on the other side in the conveyance direction (the left side in FIG. 5) of one of the first to fourth common electrodes 12*b*1 to 12*b*1 corresponding thereto, respectively.

As depicted in FIG. 4, the COF 18 has an insulating sheet 18*b* formed, for example, polyimide, etc., a plurality of individual trace 18*f* electrically connected to the individual contact points 12*f*, respectively, and two common traces (not depicted) electrically connected to the two common contact points 12*g*, respectively.

One end of the COF 18 is adhered to the channel substrate 11, via an adhesive A, in a state that the individual traces 18*f* and the two common traces face the individual contact points 12*f* and two common contact point 12*g*, respectively. The other end of the COF 18 is electrically connected to the controller 5 (see FIG. 1).

A driver IC 19 is mounted on a location between the one end and the other end of the COF 18. The driver IC 19 generates a driving signal for driving the piezoelectric element 12*x*, based on a signal from the controller 5, and the driver IC 19 supplies the driving signal to each of the individual electrodes 12*d*. The potential of the common electrode 12*b* is maintained at the ground potential. In a case that the driving signal is supplied to each of the individual electrodes 12*d*, the potential of each of the individual electrodes 12*d* is changed between a predetermined driving potential and the ground potential.

In a case that the potential of a certain individual electrode 12*d* is changed from the ground potential to the driving potential, there is generated difference in the potential between the certain individual electrode 12*d* and the common electrode 12*b*. With this, an electric field parallel to a thickness direction of a certain piezoelectric body 12*c* corresponding to the certain individual electrode 12*d* acts on a portion which is sandwiched between the certain individual electrode 12*d* and the common electrode 12*b* (hereinafter referred to as an active part). In this situation, a polarization direction of the active part (thickness direction of the certain piezoelectric body 12*c*) is coincident with the direction of the electric field, which in turn causes the active part expands in the thickness direction of the certain piezoelectric body 12*c*, and to contract in a planar direction of the certain piezoelectric body 12*c*. Accompanying with the contracting deformation of the active part, parts in the vibration plate 17 and the piezoelectric actuator 12*x* respectively which face a certain pressure chamber 11*m* corresponding to the certain individual electrode 12*d* are deformed so as to project toward the certain pressure chamber 11*m*. With this, the volume of the certain pressure chamber 11*m* is reduced, which in turn applies energy to the ink inside the certain pressure chamber 11*m*, thereby causing an ink droplet to be discharged from a certain nozzle 11*n* corresponding to the certain pressure chamber 11*m*.

In the present embodiment, each of the pressure chambers 11*m* is communicated with one of the supply channels 11*t*1 and one of the return channels 11*t*2 corresponding thereto and formed in the reservoir member 11*a*, via one of the through holes 17*x*1 and one of the through holes 17*x*2 formed in the vibration plate 17. Further, each of the through holes 17*x*1 and each of the through holes 17*x*2 are surrounded by one of the ring-shaped traces 13. Owing to this configuration, even in such a case that the ink outflows from a connection part at which each of the pressure chambers 11*m* is connected to one of the supply channels 11*t*1 and/or from a connection part at which each of the pressure chambers 11*m* is connected to one of the return channels 11*t*2, the ink is intercepted by the ring-shaped part 13*a* of one of the ring-shaped traces 13. As a result, it is possible to lower such a possibility that the ink outflowed from the connection parts might reach the piezoelectric actuator 12*x*.

The extending parts 13*b* of the ring-shaped traces 13 are electrically connected to one of the first to fourth common electrodes 12*b*1 to 12*b*4, via the parts (contact point parts 13*x*), of the extending parts 13*b*, entering into the through holes of the insulating film 12*i*. Further, the first to fourth common electrodes 12*b*1 to 12*b*4 are maintained at the ground potential. Accordingly, any difference in the potential is hardly generated between the ring-shaped traces 13 and the ink flowing in the supply channels 11*t*1 and the return channels 11*t*2. Therefore, it is possible to lower such a possibility that the ink flowing in the supply channels 11*t*1 and the return channels 11*t*2 is conducted with the ring-shaped traces 13.

Further, as depicted in FIG. 5, the shape of the ring-shaped trace 13 surrounding one of the through holes 17*x*1 is symmetric to the shape of the ring-shaped traces 13 surrounding one of the through holes 17*x*2, relative to the individual electrodes 12*d*, and the positions in the sheet width direction of the contact point parts 13 are substantially same to one another. Accordingly, it is possible to maintain the deformation of each of the piezoelectric elements 12*x* to be uniform in the conveyance direction. Furthermore, the contact point part 12*ex* of each of the individual traces 12*e* is provided on the central part in the sheet width direction of one of the individual electrodes 12*d* corresponding thereto, whereas the contact point part 13*x* of each of the ring-shaped traces 13 is shifted from the central part in the sheet width direction of one of the individual electrodes 12*d* corresponding thereto. With this it is possible to form the individual traces 12*e* preferentially.

Each of the ring-shaped traces 13 is arranged so as not to overlap with the partition wall between any two of the pressure chambers 11*m* which are adjacent to each other in the sheet width direction. In other words, only the individual traces 12*e* are arranged on the partition wall between any two of the pressure chambers 11*m* which are adjacent to each other in the sheet width direction. Accordingly, there is no need to increase the thickness of the partition wall between any two of the pressure chambers 11*m* which are adjacent to each other in the sheet width direction, for the arrangement of the ring-shaped traces 13, and it is possible to secure a sufficient width in the sheet width direction of each of the pressure chambers 11*m*.

The individual traces 12*e* and the ring-shaped traces 13 are formed of the mutually same material (for example, aluminum (Al)), and are both formed on the upper surface of the insulating film 12*i* (see FIGS. 4 and 6). Accordingly, it is possible to easily form the individual traces 12*e* and the ring-shaped traces 13 by one step, and it is possible to suppress any increase in the number of producing steps of the piezoelectric actuator 12.

Next, a modification of the above-described embodiment will be explained. In the above-described embodiment, each of the ring-shaped traces 13 is electrically connected to any one of the first to four common electrodes 12*b*1 to 12*b*4 via the contact point part 13*x*. The present disclosure, however, is not limited to this configuration. For example, as depicted in FIG. 7, it is allowable that each of the ring-shaped traces 13 is further electrically connected to other ring-shaped traces 13 via a connecting trace 16 extending in the conveyance direction.

Specifically, except for the ring-shaped traces 13 formed to construct a first row from the downstream-most side in the conveyance direction (the rightmost side in FIG. 7), each of ring-shaped traces 13 may be connected to at least one ring-shaped trace 13, which is adjacent thereto in the conveyance direction, via the connecting trace 16. Namely, it is allowable that the ring-shaped traces 13 formed on the downstream-most side in the conveyance direction are connected only to the common electrode 12*b*, and that these ring-shaped traces 13 are not connected to other ring-shaped traces 13. Further, the ring-shaped traces 13 which are arranged on the downstream-most side in the conveyance direction are arranged so as not to overlap with the partition wall between any two of the pressure chambers 11*m* which are adjacent to each other in the sheet width direction.

In contrast, ring-shaped traces 13 formed to construct a second row from the downstream-most side in the conveyance direction are connected to ring-shaped traces 13 formed to construct a fifth row from the downstream-most side in the conveyance direction, via a plurality of pieces of the connecting trace 16, respectively. Ring-shaped traces 13 formed to construct a third row from the downstream-most side in the conveyance direction are connected to ring-shaped traces 13 formed to construct a fourth row from the downstream-most side in the conveyance direction, via a plurality of pieces of the connecting trace 16, respectively. The ring-shaped traces 13 formed to construct the fourth row from the downstream-most side in the conveyance direction are connected to the ring-shaped traces 13 formed to construct the third row and to ring-shaped traces 13 formed to construct a seventh row from the downstream-most side in the conveyance direction, via a plurality of pieces of the connecting trace 16, respectively. The ring-shaped traces 13 formed to construct the fifth row from the downstream-most side in the conveyance direction are connected to the ring-shaped traces 13 formed to construct the second row and to ring-shaped traces 13 formed to construct a sixth row from the downstream-most side in the conveyance direction, via a plurality of pieces of the connecting trace 16, respectively. The ring-shaped traces 13 formed to construct the sixth row from the downstream-most side in the conveyance direction are connected to the ring-shaped traces 13 formed to construct the fifth row from the downstream-most side in the conveyance direction, via a plurality of pieces of the connecting trace 16, respectively. The ring-shaped traces 13 formed to construct the seventh row from the downstream-most side in the conveyance direction are connected to the ring-shaped traces 13 formed to construct the fourth row from the downstream-most side in the conveyance direction and to ring-shaped traces 13 formed to construct an eighth row from the downstream-most side in the conveyance direction, via a plurality of pieces of the connecting trace 16, respectively. Further, the ring-shaped traces 13 formed to construct the eighth row from the downstream-most side in the conveyance direction are connected to the ring-shaped traces 13 formed to construct the seventh row from the downstream-most side in the conveyance direction, via a plurality of pieces of the connecting trace 16, respectively.

Figure 7:
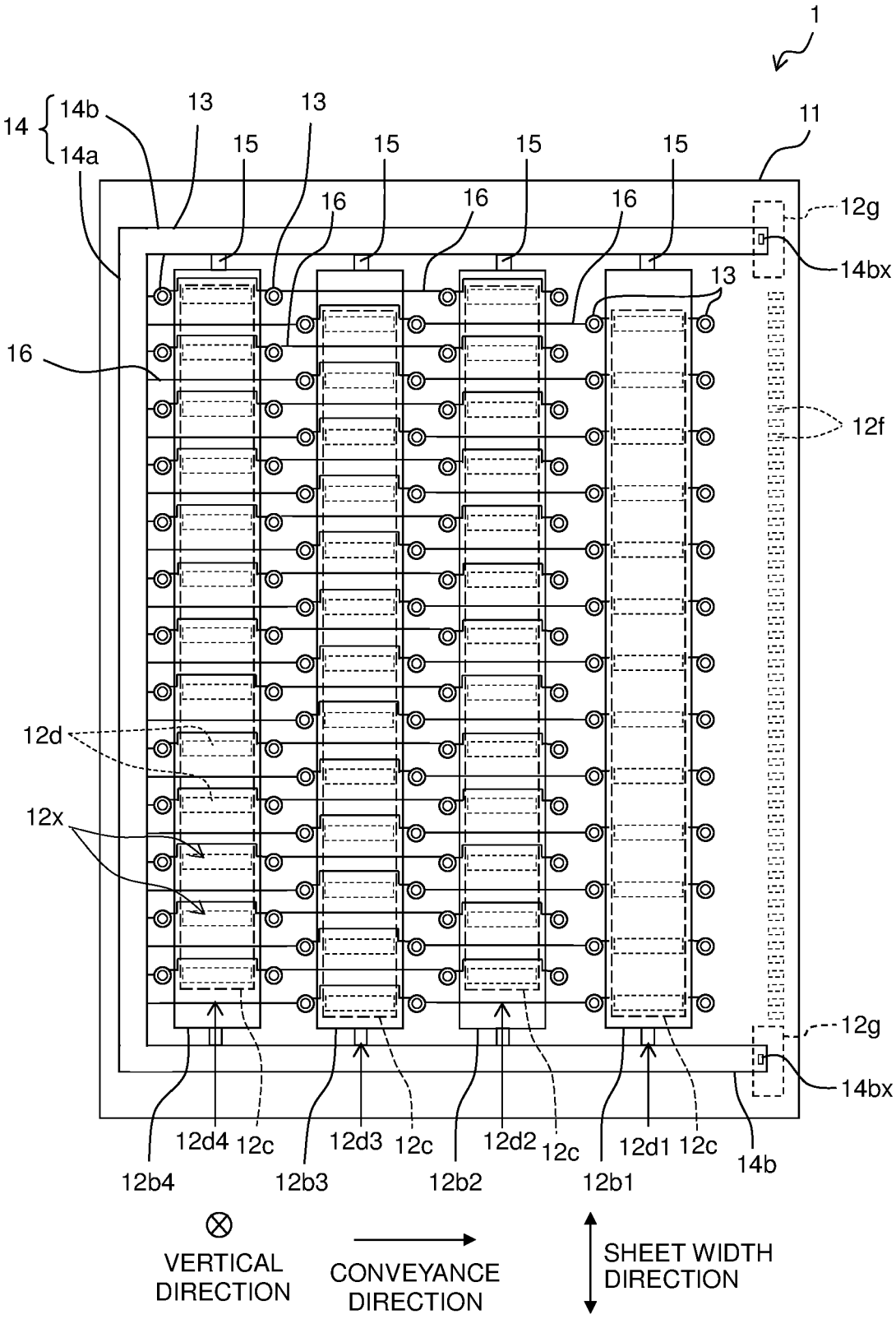
FIG. 7 is a plane view of a modification of the embodiment, corresponding to FIG. 3.

Furthermore, each of the ring-shaped traces 13 formed to construct the sixth and eighth rows on the downstream-most side in the conveyance direction (the ring-shaped traces 13 on the third and first rows from the left in FIG. 7) is connected to the facing part 14*a* of the common electrode 14 via one of the connecting traces 16. Note that in this modification, the connecting traces are formed on the insulating film 12*i*, similarly to each of the ring-shaped traces 13. Further, the width in the conveyance direction of the facing part 14*a* and the width in the sheet width direction of each of the two connecting parts 14*b* are wider than the width in the sheet width direction of each of the connecting traces 16.

According to the above-described modification, except for the ring-shaped traces 13 formed to construct the first row from the downstream-most side in the conveyance direction, each of the ring-shaped traces 13 is connected not only to any one of the second to fourth common electrodes 12*b*2 to 12*b*4, but is connected, via the connecting trace 16, also to the facing part 14*a* of the common trace 14. Namely, since the second to fourth common electrodes 12*b*2 to 12*b*4, the ring-shaped traces 13 and the connecting traces 16 are parallel-connected, it is possible to lower the ground resistance.

In the above-described modification, each of the individual traces 12*e* extends from the end part on the downstream side in the conveyance direction of one of the individual electrodes 12*d* corresponding thereto, toward the downstream side of the conveyance direction, and is connected to one of the individual contact points 12*f* formed in the end part on the downstream side in the conveyance direction of the pressure chamber plate 11*b*, and corresponding thereto, in a similar manner to the above-descried embodiment. Accordingly, the number of the individual trace 12 passing on the partition wall between the two pressure chambers 11*m* which are adjacent to each other in the sheet width direction is increased, as the pressure chamber row is located further on the downstream side in the conveyance direction. In view of this situation, in the above-described modification, the ring-shaped traces 13 formed to construct the first row from the downstream-most side in the conveyance direction are not connected to the other ring-shaped traces 13, and also are arranged so as not to overlap with the partition wall between any of the two pressure chambers which are adjacent to each other in the sheet width direction. Namely, since the ring-shaped traces 13 formed to construct the first row from the downstream-most side in the conveyance direction are not connected to the connecting traces 16, it is possible to arrange only the individual trace 12*e* on the partition wall of the two pressure chambers 11*m* which are included in the pressure chamber row 11*m*1 on the downstream-most side in the conveyance direction and which are adjacent to each other in the sheet width direction.

Further, in the above-described modification, the ring-shaped traces 13 are serially-connected in the conveyance direction via the connecting traces 16, and are connected to the facing part 14*a* of the common electrode 14. Accordingly, as compared with such a case that each of the ring-shaped traces 13 is connected to the facing part 14*a* of the common trace 14, without being connected to other ring-shaped trace(s) 13, it is possible to reduce the number of traces for connecting the respective ring-shaped traces 13 to the facing part 14*a* of the common chamber 14. As a result, it is possible to suppress any increase in the width in the sheet width direction of the partition wall between the two pressure chambers 11*m* adjacent to each other in the sheet width direction.

Further, in the above-described modification, the width in the conveyance direction of the facing part 14*a* and the width in the sheet width direction of each of the two connecting parts 14*b* are wider than the width in the sheet width direction of each of the connecting traces 16. Owing to this configuration, it is possible to further reduce the ground resistance.

It is allowable that, regarding the area in the horizontal direction of the contact point parts 13*x* of the above-described embodiment, the area in the horizontal direction is made to be greater as in a contact point part 13*x*, among the contact point parts 13*x*, which is arranged further on the upstream side in the conveyance direction and in which more electric current flows.

In the above-described embodiment, it is allowable to further form an insulating film configured to cover the individual traces 12*e*, the ring-shaped traces 13, and the connecting traces 16, in order to avoid any short circuit therebetween.

In the above-described embodiment and modification, the printer 100 performs printing on the recording sheet 9 in a so-called line head system in which the ink is discharged from the head unit 1*x* elongated in the width direction of the sheet and fixed with respect to the printer 100. It is allowable, however, that the printer 100 performs the printing on the recording sheet 9 in a so-called serial head system in which an ink-jet head is moved in the width direction of the sheet by a carriage.

In the above-described embodiment and modification, an explanation was made regarding the case wherein the present disclosure is applied to the ink-jet head which is configured to discharge the ink from the nozzles. The present disclosure, however, is not limited to this. The present disclosure is also applicable to a liquid discharging apparatus which is different from the ink-jet head and which is configured to discharge a liquid, different from the ink, from the nozzles.

What is claimed is:

1. A liquid discharge head comprising:

a first substrate having a plurality of pressure chambers formed therein, the first substrate having: a first surface in which a plurality of nozzles communicating with the pressure chambers respectively are open; and a second surface which is on a side opposite to the first surface and in which a plurality of first holes communicating with the pressure chambers respectively and a plurality of second holes communicating with the pressure chambers respectively are open;

a piezoelectric actuator which is arranged on the second surface of the first substrate, and which is configured to apply discharge energy to liquid inside the pressure chambers, wherein the piezoelectric actuator includes a first electrode arranged on the second surface of the first substrate to cover the pressure chambers;

a second substrate which is joined to the second surface of the first substrate, and in which a plurality of first channels and a plurality of second channels are formed, the first channels communicating with the pressure chambers via the first holes respectively, the second channels communicating with the pressure chambers via the second holes respectively;

a plurality of first ring-shaped traces which are connected to the piezoelectric actuator, and each of which surrounds one of the first holes on the second surface of the first substrate; and a plurality of second ring-shaped traces which are connected to the piezoelectric actuator, and each of which surrounds one of the second holes on the second surface of the first substrate, wherein a ground potential is applied to the first electrode, and the first ring-shaped traces and the second ring-shaped traces are connected to the first electrode of the piezoelectric actuator.

2. The liquid discharge head according to claim 1, wherein the piezoelectric actuator further includes:

a piezoelectric body arranged on a surface of the first electrode on a side opposite to the first substrate; and a plurality of second electrodes which are arranged on a surface of the piezoelectric body on a side opposite to the first electrode to face the pressure chambers, respectively, and wherein one of the ground potential and a driving potential is selectively applied to each of the second electrodes.

3. The liquid discharge head according to claim 2, further comprising an insulating film which partially covers the piezoelectric actuator, wherein a plurality of first through holes and a plurality of second through holes are formed in the insulating film, the first ring-shaped traces are connected to the first electrode of the piezoelectric actuator via a plurality of first contact point parts entering into the first through holes, respectively, and the second ring-shaped traces are connected to the first electrode of the piezoelectric actuator via a plurality of second contact point parts entering into the second through holes, respectively.

4. The liquid discharge head according to claim 3, wherein the first substrate has a first end and a second end in a first direction along the first surface, the pressure chambers are aligned in a second direction which is along the first surface and crosses the first direction, each of the pressure chambers extends in the first direction, each of the first holes overlaps with an end part, of one of the pressure chambers corresponding thereto, on a side of the first end, each of the second holes overlaps with an end part, of one of the pressure chambers corresponding thereto, on a side of the second end, and each of the first ring-shaped traces and each of the second ring-shaped traces do not overlap with a partition wall between any two of the pressure chambers adjacent to each other in the second direction.

5. The liquid discharge head according to claim 3, wherein the first substrate has a first end and a second end in a first direction along the first surface, each of the pressure chambers extends in the first direction, each of the first holes overlaps with an end part, of one of the pressure chambers corresponding thereto, on a side of the first end, each of the second holes overlaps with an end part, of one of the pressure chambers corresponding thereto, on a side of the second end, the pressure chambers form a plurality of pressure chamber rows arranged side by side in the first direction, each of the pressure chamber rows is formed along a second direction crossing the first direction, the first holes form a plurality of first hole rows arranged side by side in the first direction, and each of first ring-shaped traces, which surround first holes constructing a first hole row located closest to the first end, does not overlap with a partition wall between any two pressure chambers, which are adjacent to each other in the second direction and construct a pressure chamber row located closest to the first end.

6. The liquid discharge head according to claim 5, wherein the second holes form a plurality of second hole rows arranged side by side in the first direction, the first hole rows and the second hole rows are arranged alternately in the first direction, each of the first ring-shaped traces is adjacent to at least one of the second ring-shaped traces in the first direction, except for the first ring-shaped traces surrounding the first holes constructing the first hole row located closest to the first end, each of the first ring-shaped traces is connected to at least one second ring-shaped trace included in the second ring-shaped traces and adjacent thereto in the first direction, via a connecting trace, and each of the second ring-shaped traces is connected to at least one of the first ring-shaped traces adjacent thereto in the first direction, via the connecting trace.

7. The liquid discharge head according to claim 6, wherein a common trace is further formed in the second surface of the first substrate, the common trace has a first part extending in the second direction, and two second parts extending in the first direction from both end parts in the second direction of the first part, the first part of the common trace is closer to the second end in the first direction than the second ring-shaped traces, a width in the first direction of the first part and a width in the second direction of each of the two second parts are wider than a width in the second direction of the connecting trace, each of second ring-shaped traces surrounding second holes constructing a second hole row located closest to the second end, is connected to the first part by the connecting trace, and an end part in the first direction of each of the two second parts is provided with a contact point with a wiring member.

8. The liquid discharge head according to claim 7, wherein an area along the second surface of each of the second contact point parts is greater than an area along the second surface of one of the first contact point parts which is adjacent on a side of the first end in the first direction.

9. The liquid discharge head according to claim 8, wherein the insulating film further has a plurality of third through holes formed therein, a plurality of individual traces are connected respectively to ends, of the second electrodes, on a side of the first end via a plurality of third contact point parts entering into the third through holes, each of the third contact point parts is provided on a central part, in the second direction, of one of the second electrodes corresponding thereto; and a position, in the second direction, of each of the third contact point parts is different from that of one of the first contact point parts and that of one of the second contact point parts.

10. The liquid discharge head according to claim 9, wherein the individual traces, the first ring-shaped traces, the second ring-shaped traces, and the connecting trace are formed on a surface, of the insulating film, on a side opposite to the first substrate.

11. The liquid discharge head according to claim 10, further comprising a second insulating film covering the first ring-shaped traces and the second ring-shaped traces.

* * * * *